US012114705B2

(12) United States Patent
Liu

(10) Patent No.: US 12,114,705 B2
(45) Date of Patent: Oct. 15, 2024

(54) ISOLATION MEMBER AND ATOMIZER

(71) Applicant: Shenzhen Eigate Technology Co., Ltd., Shenzhen (CN)

(72) Inventor: Tuanfang Liu, Shenzhen (CN)

(73) Assignee: SHENZHEN EIGATE TECHNOLOGY CO., LTD., Shenzhen (CN)

( * ) Notice: Subject to any disclaimer, the term of this patent is extended or adjusted under 35 U.S.C. 154(b) by 176 days.

(21) Appl. No.: 17/543,623

(22) Filed: Dec. 6, 2021

(65) Prior Publication Data

US 2022/0361577 A1 Nov. 17, 2022

(30) Foreign Application Priority Data

May 16, 2021 (CN) ..... 202121045587.X

(51) Int. Cl.
*A24F 40/485* (2020.01)
*A24F 40/10* (2020.01)
*A24F 40/40* (2020.01)

(52) U.S. Cl.
CPC ..... *A24F 40/485* (2020.01); *A24F 40/10* (2020.01); *A24F 40/40* (2020.01)

(58) Field of Classification Search
CPC ..... A24F 40/10; A24F 40/40; A24F 40/485
See application file for complete search history.

(56) References Cited

U.S. PATENT DOCUMENTS 10,959,460 B2 * 3/2021 Qiu ..... A24F 40/44
2022/0022538 A1 * 1/2022 Qiu ..... A24F 40/42

FOREIGN PATENT DOCUMENTS

CN 112189902 A * 1/2021 ..... A24F 40/10
CN 112772974 A * 5/2021 ..... A24F 40/10

OTHER PUBLICATIONS

Machine Translation of CN 112189902 (Year: 2024).*
Machine Translation of CN 112772974 (Year: 2024).*

* cited by examiner

*Primary Examiner* — Russell E Sparks
(74) *Attorney, Agent, or Firm* — MATTHIAS SCHOLL P.C.; Matthias Scholl

(57) ABSTRACT

An isolation member for an atomizer includes a main body and a pull rod connected to the main body to drag the main body to move. The main body includes a hollow channel.

9 Claims, 8 Drawing Sheets

ISOLATION MEMBER AND ATOMIZER

CROSS-REFERENCE TO RELATED APPLICATIONS

Pursuant to 35 U.S.C.§ 119 and the Paris Convention Treaty, this application claims foreign priority to Chinese Patent Application No. 202121045587.X filed May 16, 2021, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to an isolation member and an atomizer.

Conventional atomizers include e-liquid tanks and atomizing cores. The atomizing cores are provided with e-liquid inlets through which the e-liquid in the e-liquid tank can flow into the atomizing cores and is atomized by heating elements to produce aerosol.

The e-liquid may flow through the e-liquid inlets out of the atomizers, thus staining the atomizers. Outside air can also enter the e-liquid inlets into the e-liquid tanks to oxidize the e-liquid before atomization, affecting the taste of the e-liquid. The e-liquid may flow through the e-liquid inlets into the atomizing cores to contact with the heating element before atomization, which leads to a shortened service life of the heating element.

SUMMARY

The disclosure is to provide an isolation member and an atomizer used in conjunction with the same; the isolation member comprises a main body comprising a hollow channel, and a pull rod connected to the main body to drag the main body to move. The atomizer comprises an atomizing tube disposed in the hollow channel; the atomizing tube comprises at least one e-liquid inlet sealed by the hollow channel; in use, the main body is pulled by the pull rod away from the at least one e-liquid inlet, which allows the e-liquid to flow through the at least one e-liquid inlet.

In a class of this embodiment, the main body comprises a limiting portion configured to limit sliding of the main body in the atomizer; the main body is formed integrally with or connected to the pull rod; a junction between the main body and the pull rod comprises a gouge that facilitates pulling the pull rod out from the main body; the limiting portion allows the main body to slide only within a certain limited range in the atomizer while preventing the main body from sliding out of the atomizer; the pull rod is pulled by an applied force, causing the main body to move to a designated position; and subsequently the force increases, causing the pull rod to be pulled outside the main body.

In a class of this embodiment, the main body comprises a first sleeve and a second sleeve; the first sleeve has a reduced diameter than the second sleeve; the second sleeve comprises a proximal end near the first sleeve and a step protruding from the proximal end and functioning as the limiting portion; the atomizer comprises an e-liquid tank; the e-liquid tank comprises a top open, an air conduction tube, and an e-liquid chamber; the top open is configured to function as mouthpiece; the mouthpiece extends downward to communicate with the air conduction tube; the e-liquid chamber is defined by an inner wall of the e-liquid tank and an outer wall of the air conduction tube; the main body is disposed in a lower portion of the air conduction tube; the main body is movable in the air conduction tube and abuts against the step to seal the e-liquid chamber; the step is configured to limit changes in the position of the air conduction tube and seal the e-liquid chamber; the first sleeve is disposed into the air conduction tube; the second sleeve is disposed under the air conduction tube and in the e-liquid chamber.

In a class of this embodiment, the second sleeve further comprises a flange protruding radially from the step; the step and the flange constitute the limiting portion; the step and the flange are configured to limit change in the position of the air conduction tube and enhance the leak resistance of the e-liquid tank.

In a class of this embodiment, the isolation member comprises an outer surface and a flange protruding radially from the outer surface; the flange constitutes the limiting portion.

In a class of this embodiment, the pull rod comprises a rod body and a cap portion disposed on one end of the rod body; the cap portion is disposed into an open top of the first sleeve to seal the first sleeve; and a junction between the cap portion and the first sleeve comprises the gouge. The main body is disposed around the atomizing tube; the atomizing tube constitutes an atomizing channel; the air conduction tube is hollow and is connected to the atomizing tube to constitute an air channel; when the atomizer is overheated to expand or overcooled to contract, cracks form in the atomizer and leads to leakage of e-liquid and smoke; when the cap portion is pulled out of the main body, the air channel is opened, thus allowing aerosol to be inhaled by a user.

In a class of this embodiment, the first sleeve comprises an outer wall and at least one lubricating boss protruding radially from the outer wall; the at least one lubricating boss is configured to reduce the contact area and friction between the main body and the air conduction tube, thus allowing smooth movement of the main body in the air channel; when the friction is too large, the pull rod is pulled outside the atomizer before the main body slides.

In a class of this embodiment, the at least one lubricating boss is in the shape of a sheet and is disposed axially on the outer wall of the first sleeve; or each of the at least one lubricating boss is disposed helically on the outer wall of the first sleeve; or the at least one lubricating boss is disposed across the outer wall of the first sleeve; preferably, each of the at least one lubricating boss is planar and disposed on the outer wall of the first sleeve along an axial direction.

In a class of this embodiment, the first sleeve further comprises a seal boss disposed under the at least one lubricating boss; the seal boss protrudes radially from the outer wall of the first sleeve and is configured to seal the air channel; an uppermost lubricating boss of the at least one lubricating boss is inclined downward and presents in a shape of a canopy; when the atomizer is overheated to expand and overcooled to contract, pressure difference is generated and maintained inside and outside of the atomizer to deform the uppermost lubricating boss; when the canopy-shaped uppermost lubricating boss is deformed by pressure difference, no cracks form in the atomizer, thus preventing leakage of the e-liquid and air.

In a class of this embodiment, the air conduction tube comprises an inner wall and a groove disposed on the inner wall and configured to equalize the pressure in the e-liquid chamber with outside pressure; the air conduction tube further comprises a through hole and/or a notch communicating with the e-liquid chamber; the groove communicates with both the air conduction channel and the through hole and/or the notch; the pull rod is pulled out of the main body to open the groove and the air conduction tube, which provides sufficient pressure for smooth flow of the e-liquid into the e-liquid tank, thus preventing the heating element from burning out; the seal boss is configured to seal a bottom portion of the groove before using the atomizer; the pull rod is pulled, causing the main body and the seal boss to slide; the seal boss is moved away from the lower portion of the air conduction tube to open the groove; when the seal boss returns to lower portion of the air conduction tube, the groove is sealed, preventing leakage of the e-liquid and air.

In a class of this embodiment, the pull rod further comprises a seal boss protruding radially from the rod body and disposed above the at least one fabricating boss; the seal boss is inclined downward and presents in a shape of a canopy; the seal boss is configured to seal the air channel and a top portion of the groove; when the atomizer is overheated to expand and overcooled to contract, pressure difference is generated and maintained inside and outside of the atomizer to deform the seal boss; when the seal boss is deformed by pressure difference, no cracks form in the atomizer, thus preventing leakage of the e-liquid and air.

In a class of this embodiment, the main body and the pull rod separately comprise silica gel, latex, rubber, or plastic, preferably silica gel; the silica gel offers advantages such as large deformation coefficient, good ductility, low friction coefficient, and good sealing performance.

In another aspect, the disclosure also provides an atomizer comprising an atomizing tube comprising at least one e-liquid inlet, and the isolation member; the isolation member is disposed around the atomizing tube to seal the at least one e-liquid inlet; and the pull rod comprises a distal end away from the main body and the distal end extends out of the main body.

The following advantages are associated with the isolation member and the atomizer of the disclosure: the at least one e-liquid inlet is sealed by the isolation member to isolate the e-liquid and inside air, thus avoiding leakage and oxidization of the e-liquid; the isolation member also prevents the e-liquid from being in contact with the heating element, avoiding burning out before use, extending service life of the heating element; the pull rod is movable in the air conduction tube to ensure that the at least one e-liquid inlet can be opened and closed, thus enhancing user experience.

Figure 1:
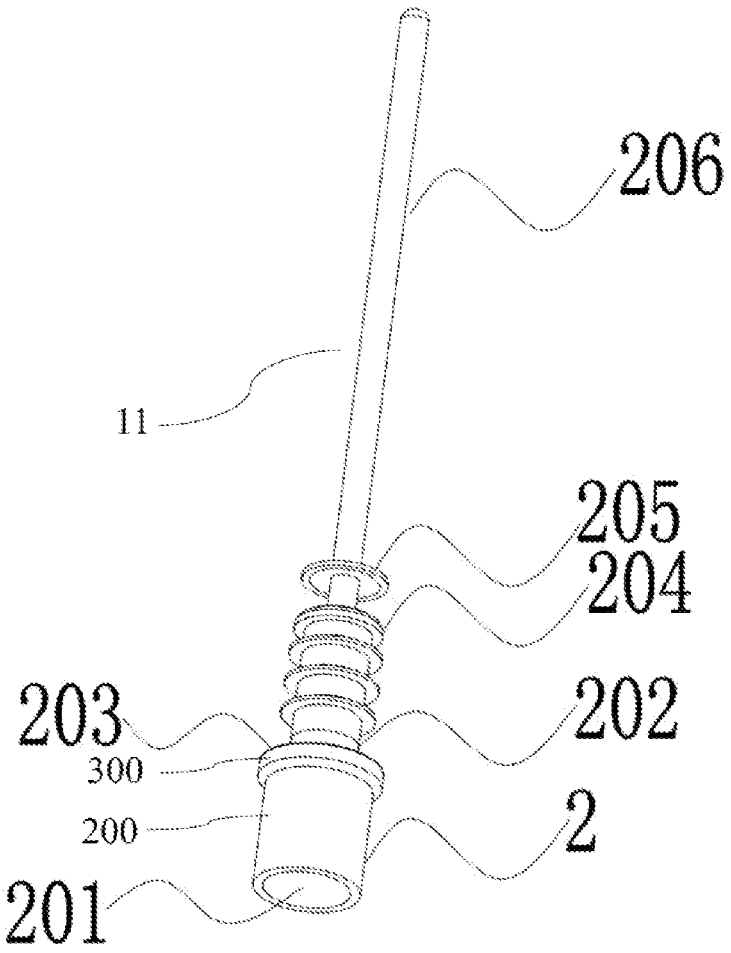
FIG. 1 is a perspective view of an isolation member according to Example 1 of the disclosure.

In the drawings, the following reference numbers are used:

1. E-liquid tank; 2. Main body; 3. Atomizing tube; 4. Heating element; 5. Seal cover; 6. Fixing base; 7. Insulating member; 8. Electrode; 9. Magnetic member; 10. Seal member; 11. Pull rod; 105. E-liquid chamber; 106. Groove; 107. Air duct; 201. Hollow channel; 202. First sleeve; 203. step; 204. Lubricating boss; 205. Seal boss; 206. Rod body; 207. Gouge; 300. Flange; 301. First e-liquid inlet; 302. Atomizing channel; 500. Cap portion; and 601. Air inlet.

DETAILED DESCRIPTION

To further illustrate, embodiments detailing an isolation member and an atomizer comprising the same are described below. It should be noted that the following embodiments are intended to describe and not to limit the disclosure.

EXAMPLE 1

Figure 2:
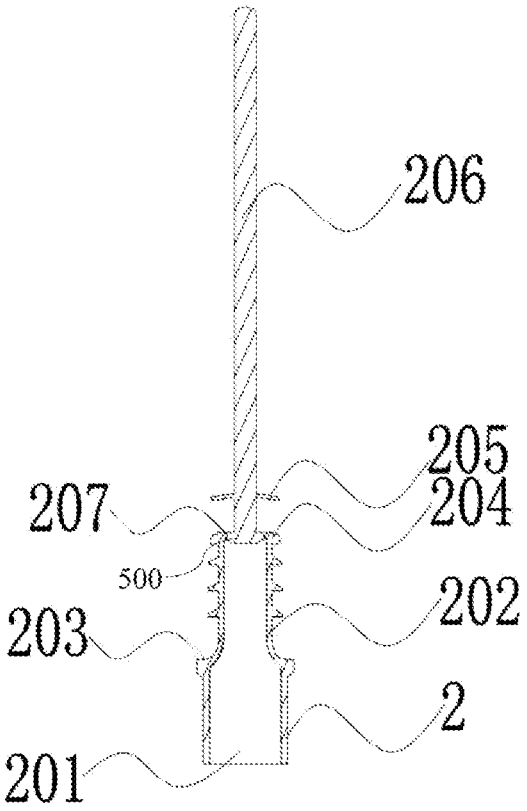
FIG. 2 is a cross-sectional view of an isolation member according to Example 1 of the disclosure.

Referring to FIGS. 1-2, an isolation member comprises a main body 2 comprising a hollow channel 201, and a pull rod 11 connected to the main body to drag the main body to move.

The main body 2 comprises a first sleeve 202 and a second sleeve 200 connected to the first sleeve 202. The first sleeve 202 has a reduced diameter than the second sleeve 200. The second sleeve 200 comprises a proximal end near the first sleeve 202 and a step 203 disposed on the proximal end. The step 203 is configured to abut against the air conduction tube 101. The second sleeve further comprises a flange 300 protruding radially from the step 203.

The pull rod 11 comprises a rod body 206 and a cap portion 500 disposed on one end of the rod body 206. The first sleeve 202 comprises an open top and the cap portion 500 is disposed into the open top to seal the first sleeve 202. A junction between the cap portion 500 and the first sleeve 202 comprises a gouge 207.

The first sleeve 202 comprises an outer wall and a plurality of lubricating bosses 204 protruding radially from the outer wall. The number of the plurality of lubricating bosses 204 is matched to demand. In this example, four lubricating bosses 204 are disposed on the first sleeve 202 to reduce resistant force while preventing e-liquid from leaking from a groove 106. The plurality of lubricating bosses 204 is in the shape of an annular disc.

The pull rod 11 further comprises a seal boss 205 protruding radially from the rod body 206 and configured to seal the groove 106. The groove 106 is configured to equalize the pressure in an e-liquid chamber 105 with outside pressure. The seal boss 205 is in the shape of an annular disc. The seal boss 205 is disposed above the plurality of lubricating bosses 204 and is inclined downward and presents in a shape of a canopy, which avoids pressure difference between inside and outside of an atomizer. The upper surface of the seal boss 205 abuts against the bottom surface of the first convex part 104 so as to seal the groove 106 and keep the groove 106 separated from the air channel 102.

Figure 3:
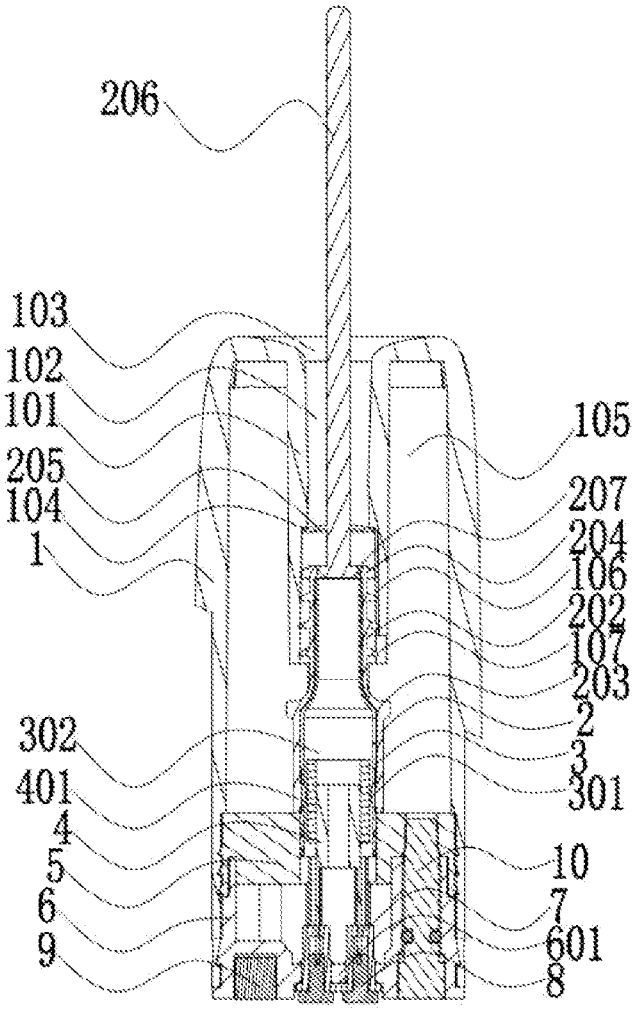
FIG. 3 is a cross-sectional view of an atomizer used in conjunction with an isolation member according to Example 1 of the disclosure.
Figure 4:
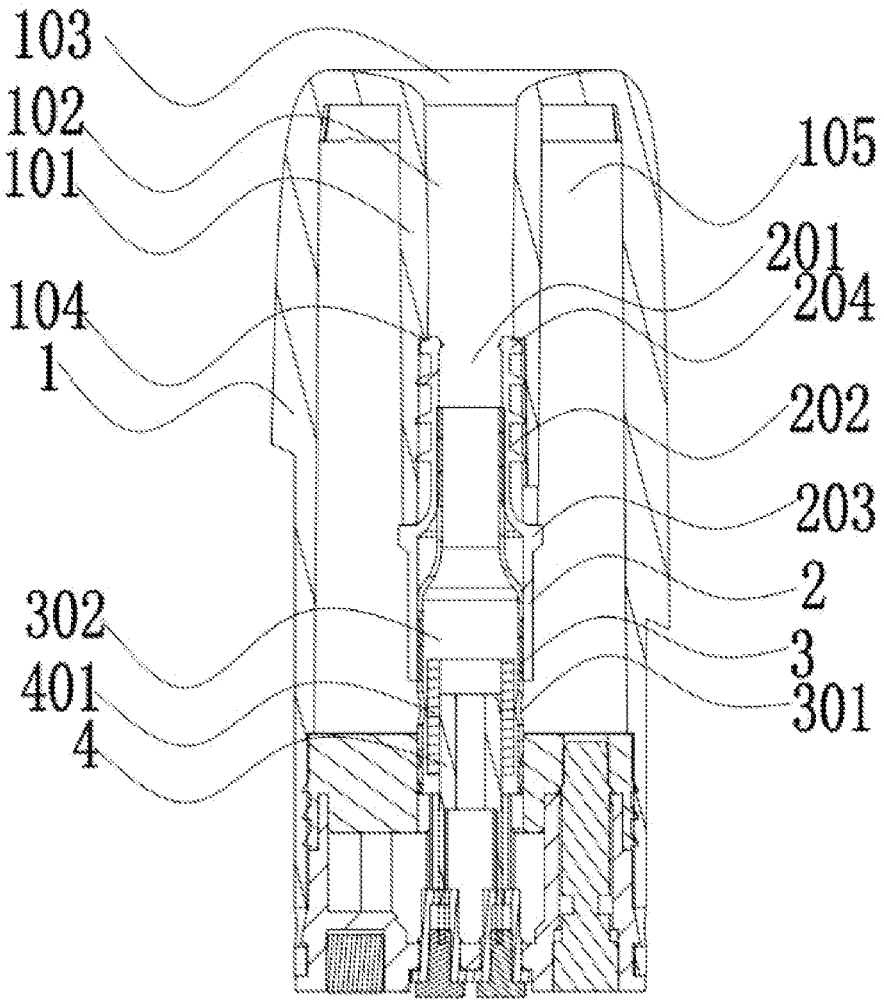
FIG. 4 is another cross-sectional view of an atomizer used in conjunction with an isolation member according to Example 1 of the disclosure.

Referring to FIGS. 3-4, an atomizer comprises an e-liquid tank 1, the main body 2, an atomizing tube 3, a heating element 4, a seal cover 5, a fixing base 6, two insulating members 7, two electrodes 8, a magnetic member 9, and a seal member 10. The heating element 4 is wrapped in a piece of e-liquid absorbent cotton. The atomizing tube 3 constitutes an atomizing channel 302 configured for air conduction and emission. The atomizing tube 3 comprises a peripheral wall and at least one first e-liquid inlet 301 disposed on the peripheral wall. The heating element 4 is disposed in the atomizing channel 302 to atomize the e-liquid. The heating element 4 corresponds to at least one first e-liquid inlet 301.

The hollow channel 201 is disposed around the atomizing tube 3 to seal the at least one first e-liquid inlet 30. The e-liquid tank 1 comprises an e-liquid chamber 105 and an air conduction tube 101. The air conduction tube 101 is hollow and is connected to the atomizing tube 3 to constitute an air channel 102. The air channel 102 communicates with outside environment so as to allow air or smoke to flow through. The e-liquid tank 1 comprises a top open functioning as a mouthpiece 1. The mouthpiece 1 communicates with the air channel 102. The air conduction tube 101 extends from the mouthpiece 103 downward into the e-liquid tank 1. The air conduction tube 101 comprises an inner wall and one end of the inner wall is concave to form a first concave part and a first convex part 104. The first convex part 104 is disposed on the first concave part. The air conduction tube 101 comprises a side wall and an air duct 107 disposed on a bottom portion of the side wall. The air duct 107 communicates with the e-liquid chamber 105 to ensure that outside air can flow into the e-liquid chamber to equalize the pressure in the e-liquid chamber with the outside pressure. The air conduction tube 101 further comprises the groove 106 disposed on the first concave part and communicating with the air duct 107. The groove 106 extends to the first convex part 104 to conduct the air in the air conduction tube 102 into the air duct 107.

The main body 2 comprises the first sleeve 202 and the second sleeve 200 connected to the first sleeve 202. The first sleeve 202 has a reduced diameter than the second sleeve 200. The second sleeve 200 comprises the proximal end disposed near the first sleeve 202 and the step 203 protrudes from the proximal end. The step 203 is configured to abut against the air conduction tube 101. The first convex part 104 is disposed in the air channel 102 and the first sleeve 202 is disposed under the first convex part 104. The second sleeve 200 is disposed in the e-liquid chamber 105 and is disposed around the atomizing tube 3 to seal the at least one first e-liquid inlet 301. The second sleeve further comprises the flange 300 protruding radially from the step 203.

The first sleeve 202 comprises the outer wall and a plurality of lubricating bosses 204 protruding radially from the outer wall. The plurality of lubricating bosses 204 abuts against the inner wall of the air conduction tube 101 to reduce contact area and friction between the first sleeve 202 and the air conduction tube 101. If the friction is too large, the pull rod 11 will be pulled outside the atomizer before the main body 2 slides.

Gaps are defined by the plurality of lubricating bosses 204 and an outer wall of the groove 106. When the pull rod 11 is pulled out of the open top of the first sleeve 202, the outside air flows through the gaps and enters the air duct 107 into the e-liquid chamber 105 to equalize the pressure in the e-liquid chamber 105 with the outside pressure.

The pull rod 11 comprises the cap portion 500 disposed on one end of the rod body 206. The cap portion 500 is disposed into the open top of the first sleeve 202. The junction between the cap portion 500 and the first sleeve 202 comprises the gouge 207, which facilitates pulling the cap portion 500 out from the first sleeve 202. The other end of the rod body 206 extends from the air channel 102 through the mouthpiece 103 out of the e-liquid tank 1 to ensure that the pull rod 11 can be pulled outside the atomizer. The pull rod 11 is pulled outside the atomizer to open the air channel 102. The seal boss 205 abuts against the first convex part 104 to seal the groove 106. The seal boss 205 is inclined downward and presents in a shape of a canopy, which avoids pressure difference due to temperature differences between inside and outside of the atomizer, thus preventing deforming of the seal boss 205 and enhancing the leak resistance of the atomizer.

The rod body 206 is pulled upward, causing the main body 2 to slide upward as well. The first sleeve 202 is moved to the bottom end of the air conduction tube 101 to communicate with the air channel 102. The cap portion 500 is pulled out of the open top of the first sleeve 202 and subsequently pulled outside the mouthpiece 103 to ensure that the air channel 102 is opened and the at least one first e-liquid inlet 301 communicates with the e-liquid chamber 105. The e-liquid flows through the at least one first e-liquid inlet 301 into the heating element 4 and is atomized to produce smoke and e-cigarette vapor. The outside air flows through the mouthpiece 103, the air channel 102, the groove 106, and the air duct 107, and enters the e-liquid chamber 105.

The seal cover 5 is disposed in the e-liquid chamber 105 to seal the e-liquid. One end of the atomizing tube 3 is disposed into the seal cover 5. The fixing base 6 is disposed in a bottom portion of the e-liquid tank 1. The two insulating members 7 are disposed in a bottom portion of the fixing base 6 to isolate the conductive wires of the heating element 4. The bottom portion of the fixing base 6 comprises an air inlet 601. The two electrodes 8 are disposed in the two insulating members 7, respectively, and are electrically connect to the heating element 4. The magnetic member 9 is disposed in the bottom portion of the fixing base 6. The fixing base 6 further comprises a second e-liquid inlet. The seal member 10 is disposed in the second e-liquid inlet to seal the e-liquid after filling of the e-liquid tank 1 is complete.

Figure 5:
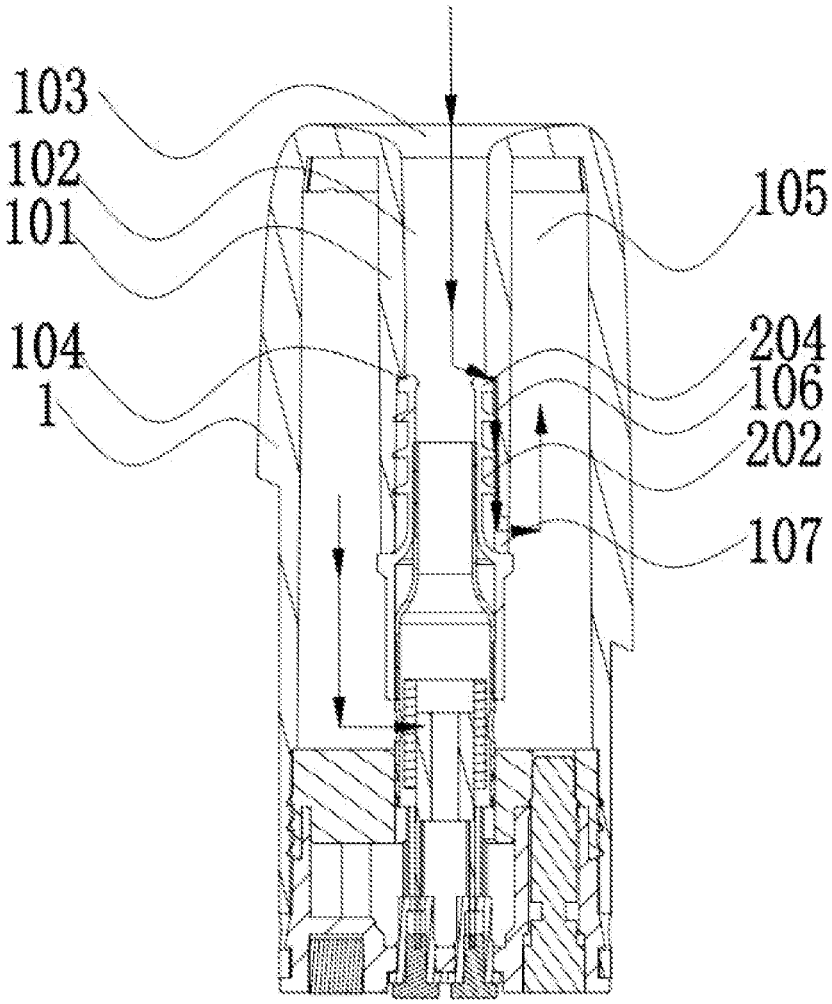
FIG. 5 is a cross-sectional view including arrows showing the direction of air flow according to Example 1 of the disclosure.

FIG. 5 is a cross-sectional view including arrows showing the route of the outside air entering the e-liquid tank 1. The cap portion 500 is pulled out of the open top of the first sleeve 202 and subsequently pulled outside the mouthpiece 103 to ensure that the air channel 102 is opened and the at least one first e-liquid inlet 301 communicates with the e-liquid chamber 105. The e-liquid flows through the at least one first e-liquid inlet 301 into the heating element 4 and is atomized to produce smoke and e-cigarette vapor. The outside air flows through the mouthpiece 103, the air channel 102, the gaps, and the air duct 107, and enters the e-liquid chamber 105 to provide sufficient pressure for smooth flow of the e-liquid into the e-liquid tank 1.

The route of the airflow in the atomizer is detailed as follows: the outside air flows through the second air inlet 601 into the atomizing channel 302, causing the heating element 4 to atomize the e-liquid. The smoke or e-cigarette vapor produced flows through the air channel 102 into the mouthpiece 103 and is inhaled by a user.

EXAMPLE 2

Figure 6:
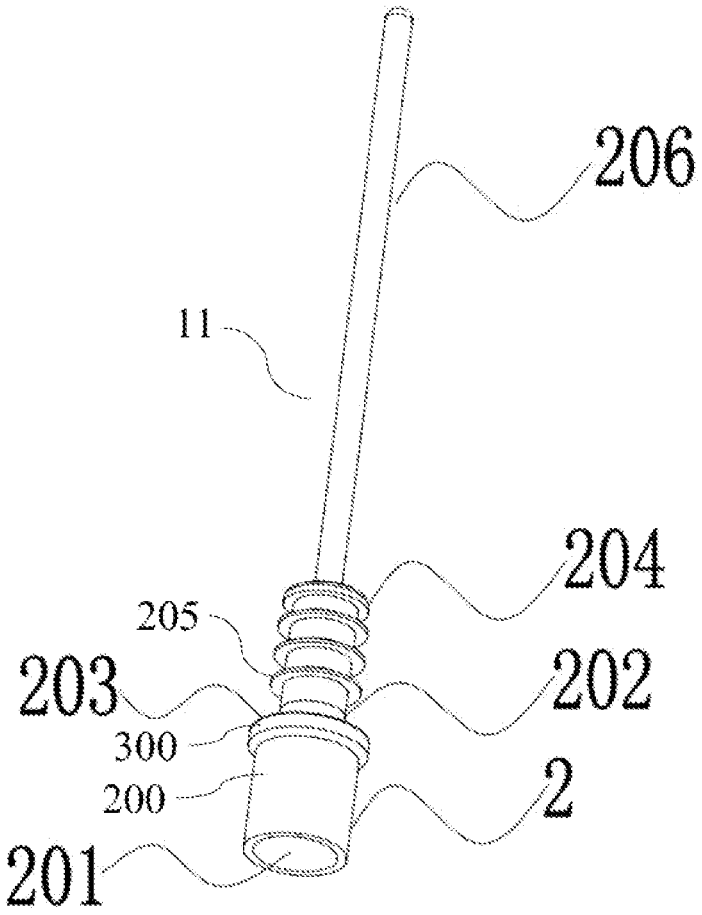
FIG. 6 is a perspective view of an isolation member according to Example 2 of the disclosure.
Figure 7:
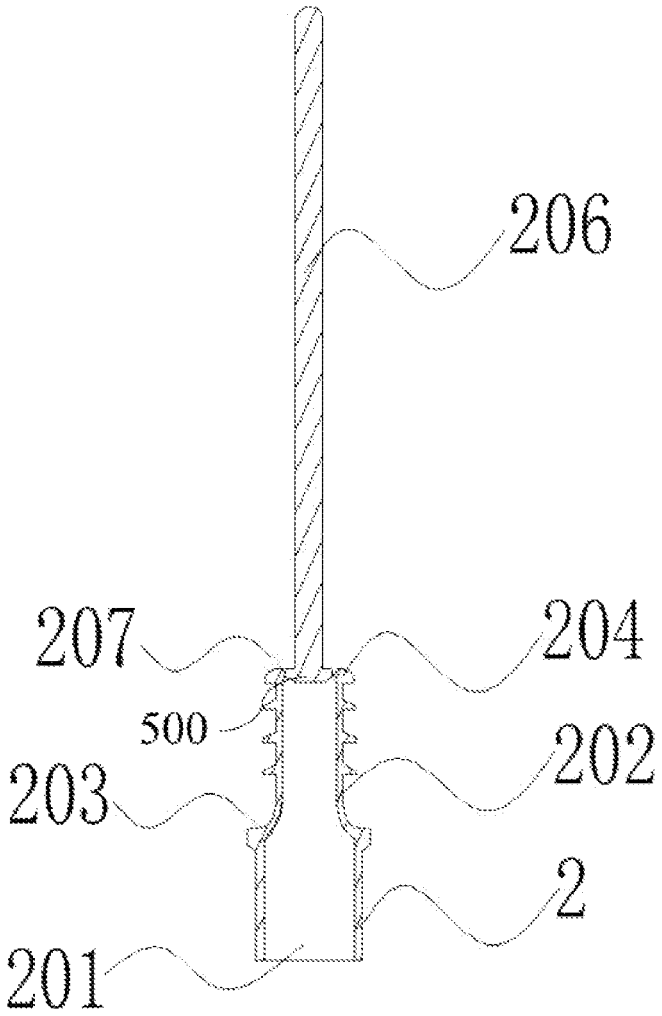
FIG. 7 is a cross-sectional view of an isolation member according to Example 2 of the disclosure.

A second example of the isolation member is illustrated in FIGS. 6-7. It is similar to the example described above in connection with FIGS. 1-5, except for the specific differences described below. The seal boss 205 is disposed on an outer wall of the main body 2; the seal boss 205 is configured to seal the other end of the groove 106 and function as the plurality of lubricating bosses 204.

Figure 8:
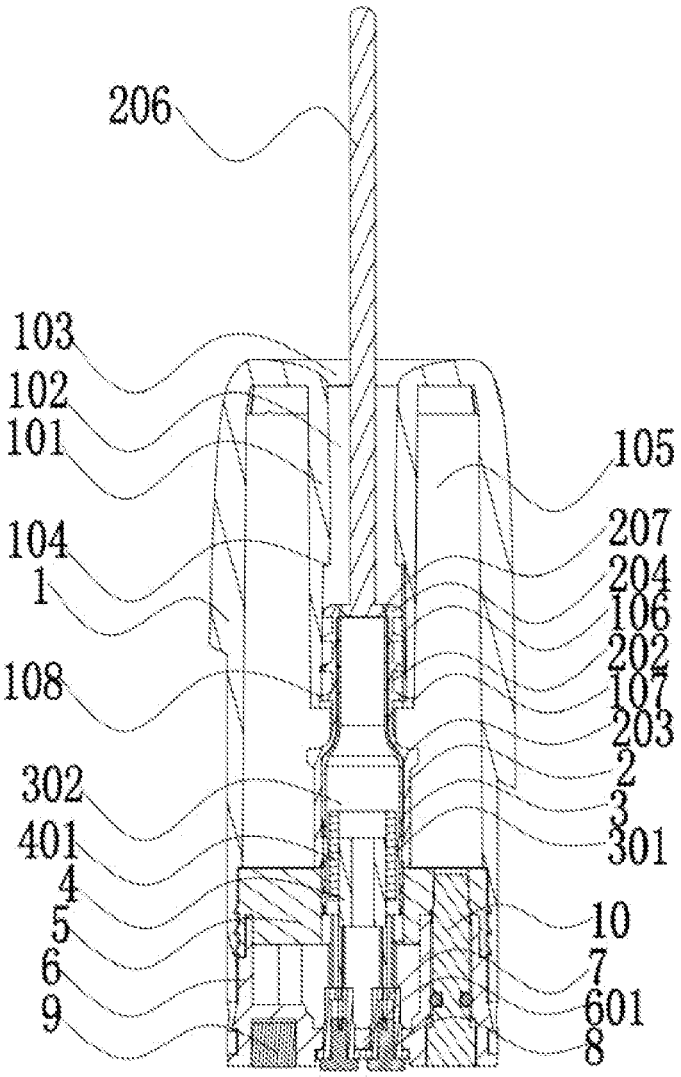
FIG. 8 is a cross-sectional view of an atomizer used in conjunction with an isolation member according to Example 2 of the disclosure.

Referring to FIG. 8, one end of the inner wall of the air conduction tube 101 is concave to form a first concave part and a first convex part 104. The first concave part extends from the first convex part 104 to the bottom end of the air conduction tube 101. The first concave part comprises a distal end away from the mouthpiece 103 and the distal end is concave to form a second concave part and a second convex part 108. The groove 106 is disposed on the first concave part and extends from the first convex part 104 to the second convex part 108. The seal boss 205 is disposed on the outer wall of the main body instead of the pull rod 11. The seal boss 205 is configured to abut against the second convex part 108 and function as the plurality of the lubricating bosses 204.

It will be obvious to those skilled in the art that changes and modifications may be made, and therefore, the aim in the appended claims is to cover all such changes and modifications.

What is claimed is:

1. An isolation member for an atomizer, the isolation member comprising a main body and a pull rod connected to the main body to drag the main body to move, and the main body comprising a hollow channel;

wherein:

the isolation member further comprises a slitting groove at a junction between the main body and the pull rod, and the slitting groove is adapted to facilitate detachment of the pull rod from the main body;

the main body comprises a first sleeve and a second sleeve; a diameter of the first sleeve is smaller than a diameter of the second sleeve; a step is disposed on the second sleeve; and the first sleeve comprises an outer wall and at least one lubricating boss protruding radially from the outer wall.

2. The isolation member of claim 1, wherein the second sleeve further comprises a flange protruding radially from the step.

3. The isolation member of claim 1, wherein the isolation member comprises an outer surface and a flange protruding radially from the outer surface.

4. The isolation member of claim 2, wherein the pull rod comprises a rod body and a cap portion disposed on one end of the rod body; the cap portion is disposed into an open top of the first sleeve to seal the first sleeve.

5. The isolation member of claim 1, wherein the at least one lubricating boss is in the shape of a sheet and is disposed axially on the outer wall of the first sleeve; or the at least one lubricating boss is disposed helically on the outer wall of the first sleeve; or the at least one lubricating boss is disposed across the outer wall of the first sleeve.

6. The isolation member of claim 1, wherein the first sleeve further comprises a seal boss disposed under the at least one lubricating boss; the seal boss protrudes radially from the outer wall of the first sleeve and is configured to seal an air channel; and an uppermost lubricating boss of the at least one lubricating boss is inclined downward and presents in a shape of a canopy.

7. The isolation member of claim 4, wherein the pull rod further comprises a seal boss protruding radially from the rod body; and the seal boss is inclined downward and presents in a shape of a canopy.

8. The isolation member of claim 1, wherein the main body and the pull rod separately comprise silica gel, latex, rubber, or plastic.

9. An atomizer, comprising an atomizing tube comprising at least one e-liquid inlet, and the isolation member of claim 1, wherein the isolation member is disposed around the atomizing tube to seal the at least one e-liquid inlet; the pull rod comprises a distal end away from the main body and the distal end extends out of the main body.

* * * * *